US007082618B1

(12) United States Patent
Muso

(10) Patent No.: US 7,082,618 B1
(45) Date of Patent: Aug. 1, 2006

(54) CAP WITH HINGED VENT FLAPS IN VISOR

(76) Inventor: Mark Muso, 40 Bushkill Ct., Reading, PA (US) 19606

( * ) Notice: Subject to any disclaimer, the term of this patent is extended or adjusted under 35 U.S.C. 154(b) by 0 days.

(21) Appl. No.: 11/151,127

(22) Filed: Jun. 13, 2005

Related U.S. Application Data

(60) Provisional application No. 60/580,920, filed on Jun. 21, 2004.

(51) Int. Cl.
*A42B 1/00* (2006.01)

(52) U.S. Cl. ..... 2/175.1; 2/195.1

(58) Field of Classification Search ..... 2/172, 2/209.12, 209.5, 209.3, 175.1, 175.3, 175.4, 2/195.1, 195.4, 195.7, 195.5
See application file for complete search history.

(56) References Cited

U.S. PATENT DOCUMENTS 2,874,387 A 2/1959 Bannister ..... 2/195
3,927,421 A * 12/1975 Simon ..... 2/12
5,487,191 A 1/1996 Ridley ..... 2/195.1
5,742,944 A * 4/1998 Pfefferman ..... 2/209.12
5,915,539 A * 6/1999 Lack ..... 2/422
6,598,237 B1 7/2003 Held ..... 2/184.5

* cited by examiner

*Primary Examiner*—John J. Calvert
*Assistant Examiner*—Andrew W. Sutton
(74) *Attorney, Agent, or Firm*—Miller Law Group, PLLC

(57) ABSTRACT

A visored cap, such as a baseball cap, has the visor is formed with one or more openings through which air can pass from beneath the visor. The visor is provided with hinged flaps formed of two members to close the openings when no air is blowing the openings and pivotally open when air needs to be moved through the openings. The first member is sized to fit closely within the dimensions of the opening, while the second member is attached to the first member and is substantially larger than the first member to cover the opening. The second member is hinged to the visor for pivotal movement. The second member can be detachable from the first member to permit a substitution of a different imprinted logo on the second member. The hinge member is formed with side members to limit pivotal movement of the flap.

19 Claims, 10 Drawing Sheets

Fig. 1
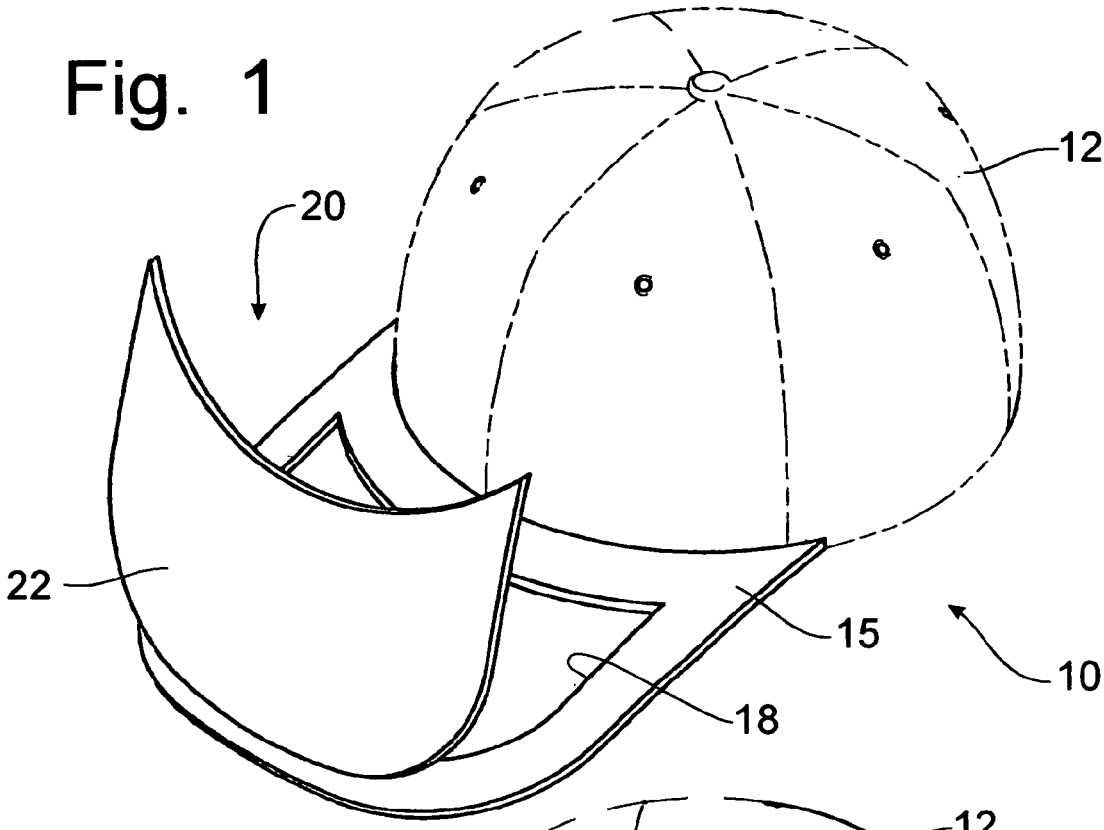
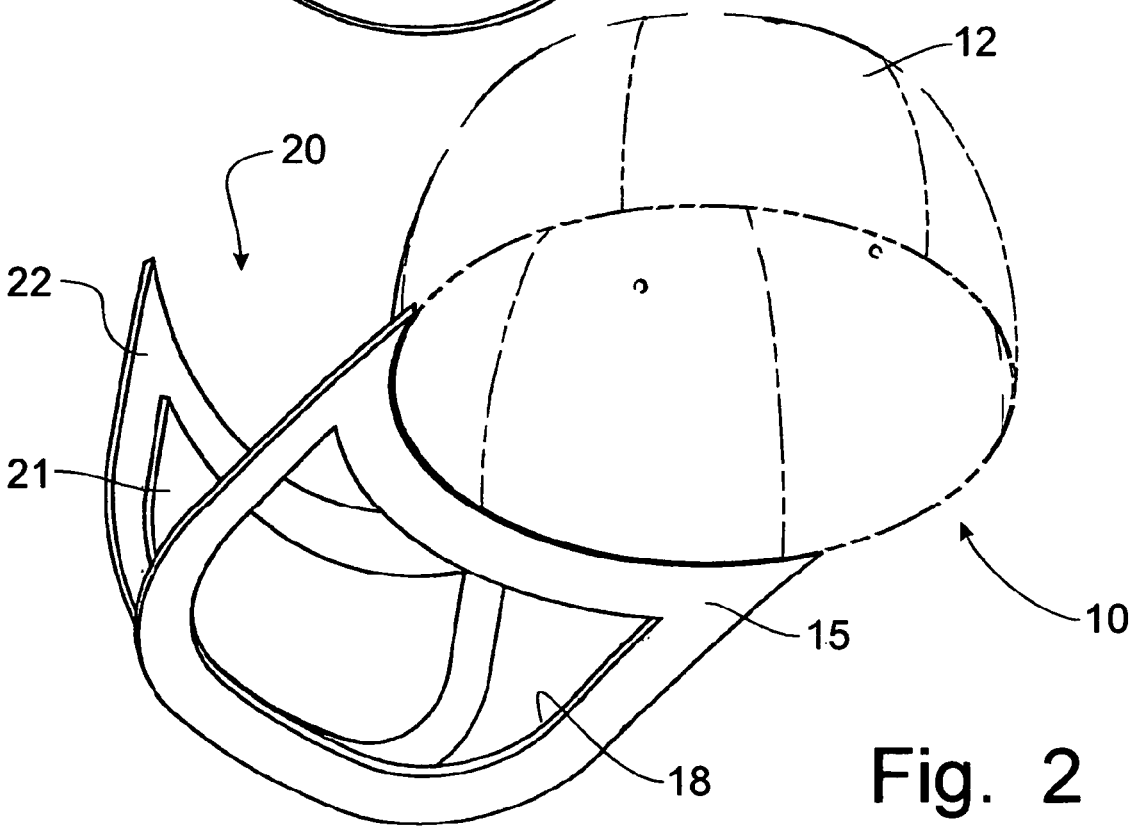
Fig. 2

Fig. 4
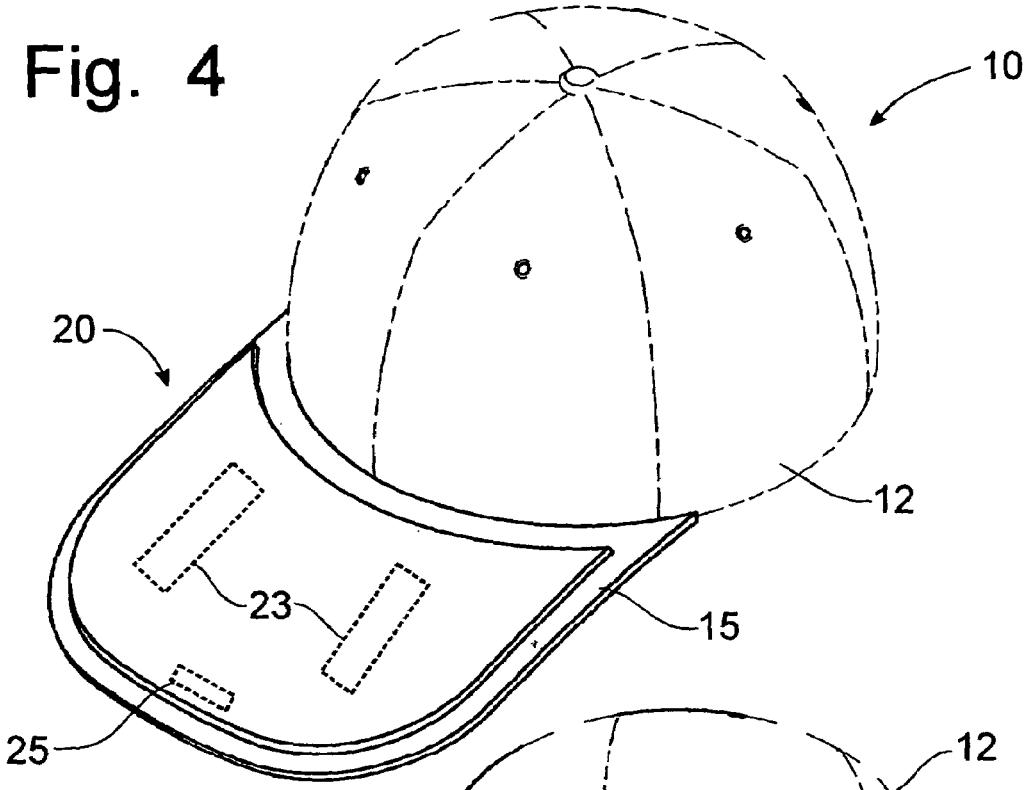
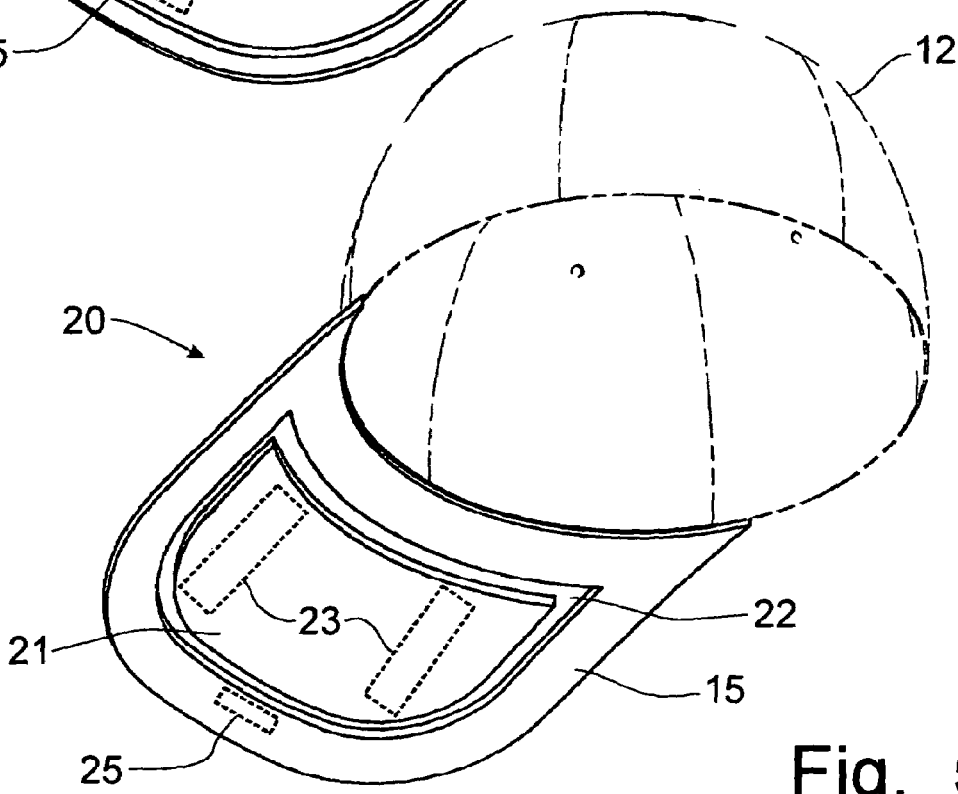
Fig. 5

Fig. 7
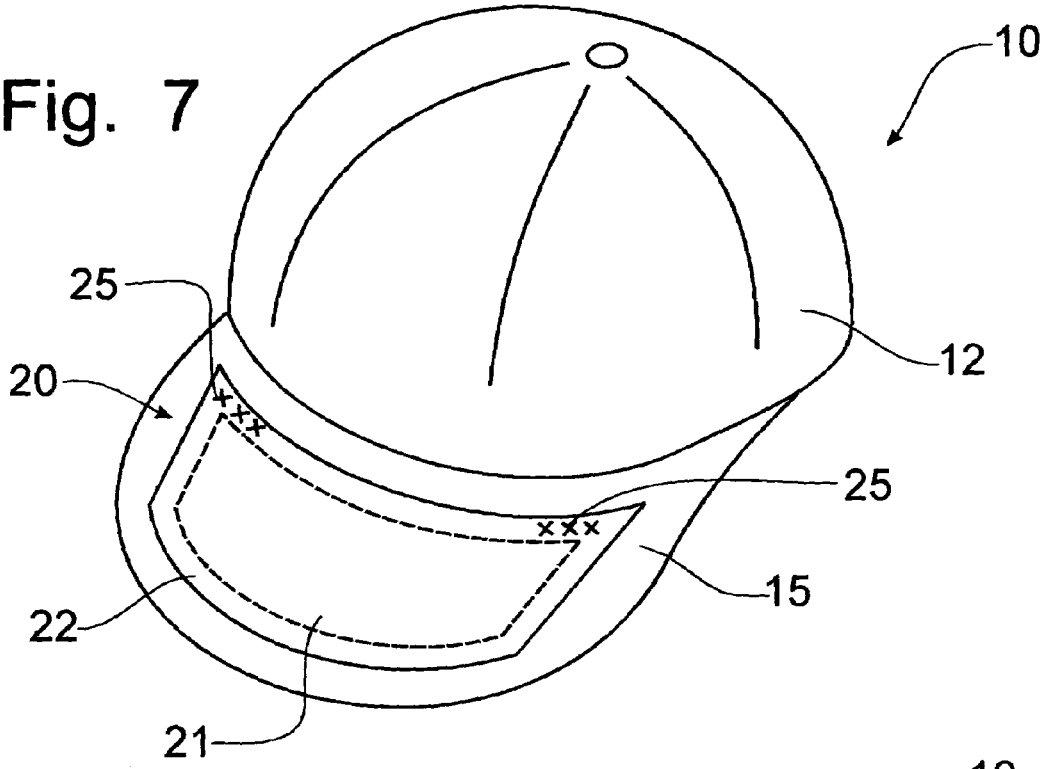
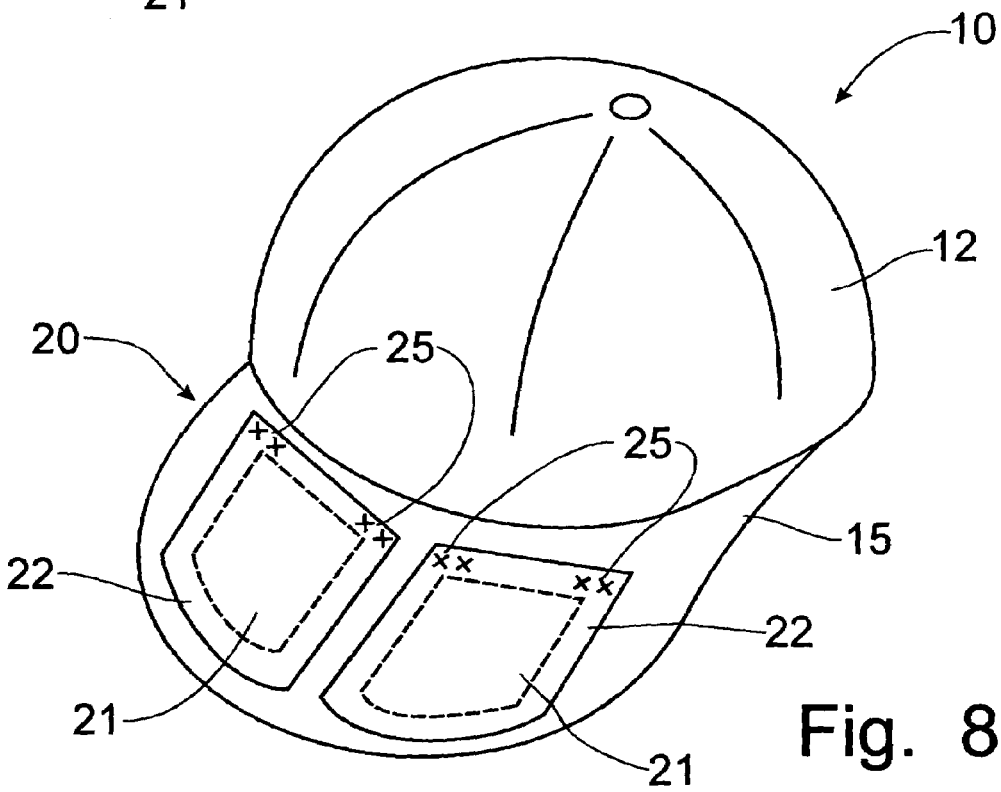
Fig. 8

Fig. 9
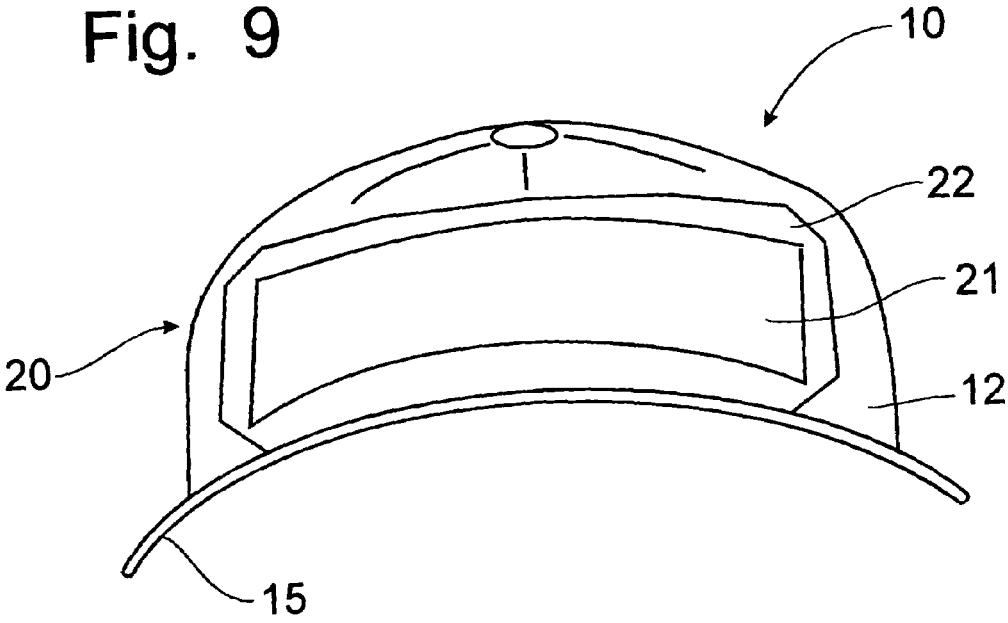
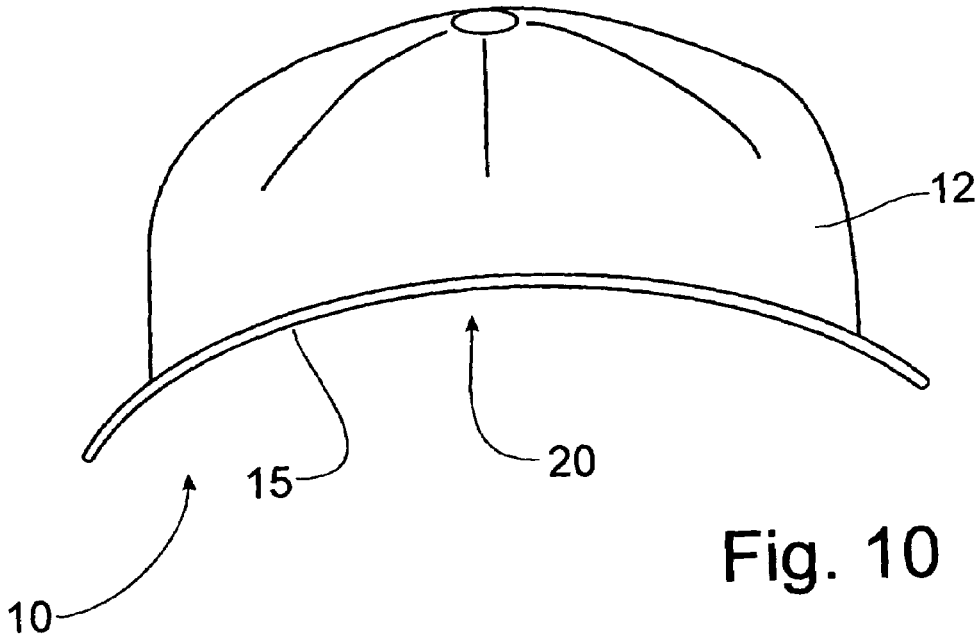
Fig. 10

Fig. 11
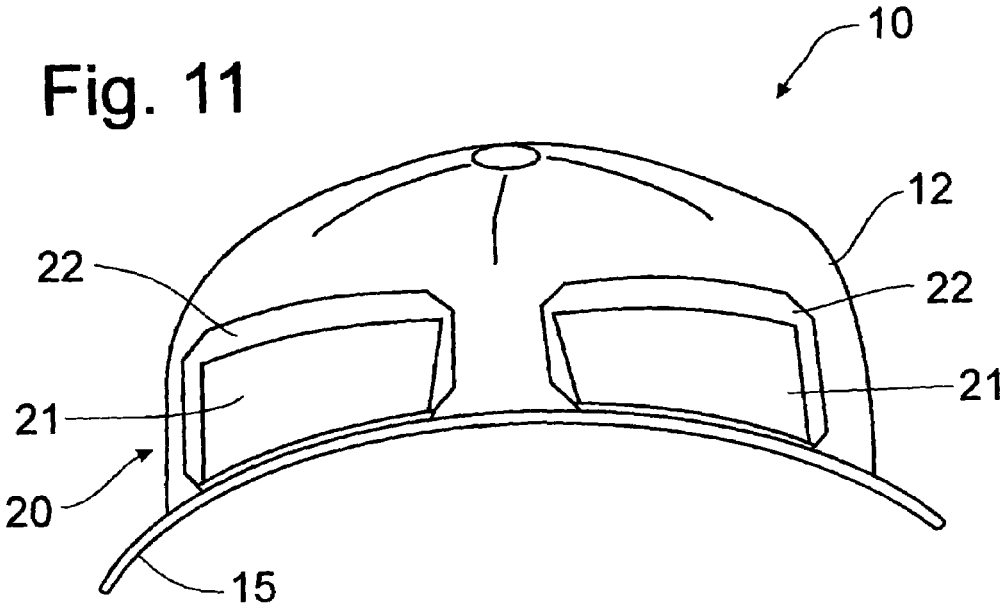
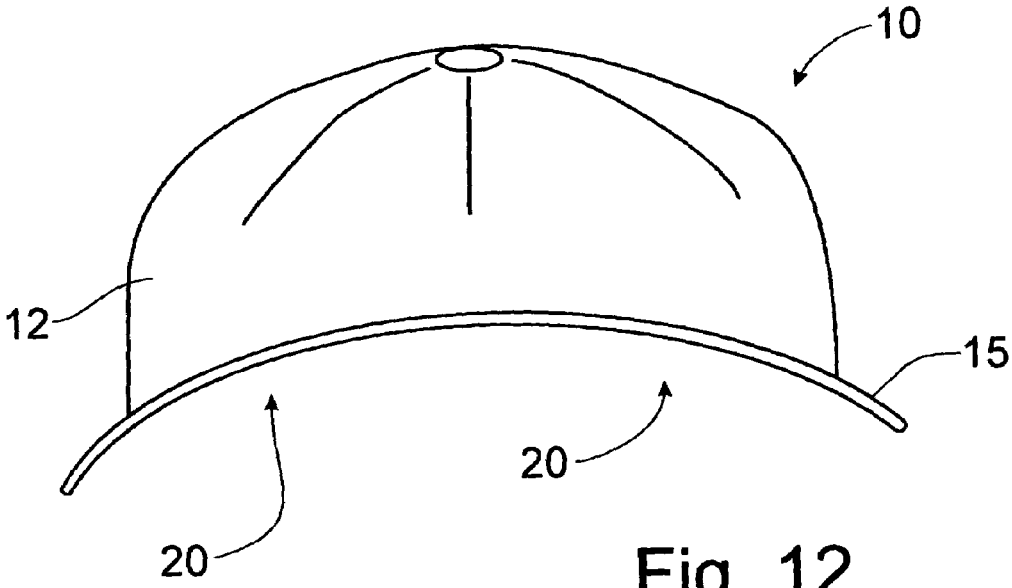
Fig. 12

Fig. 13
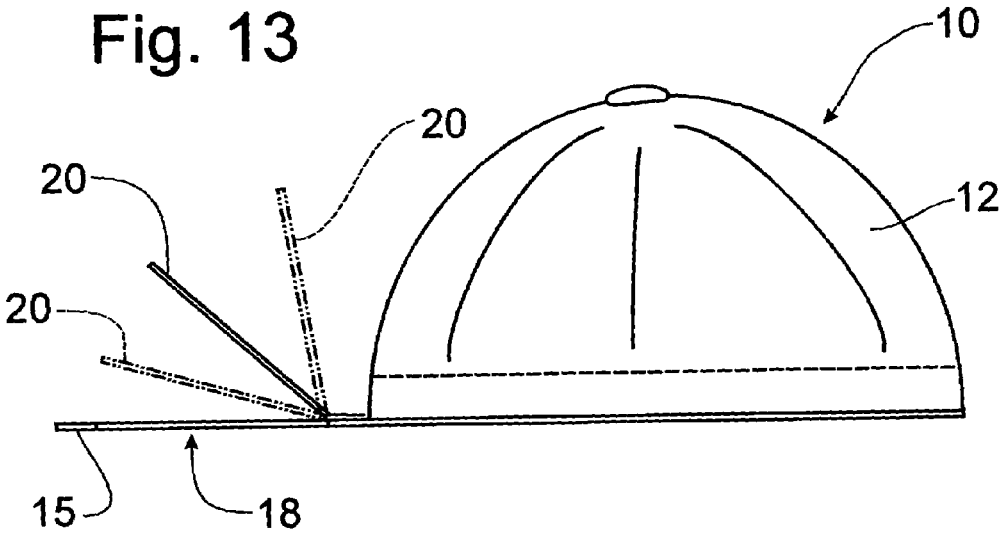
Fig. 14
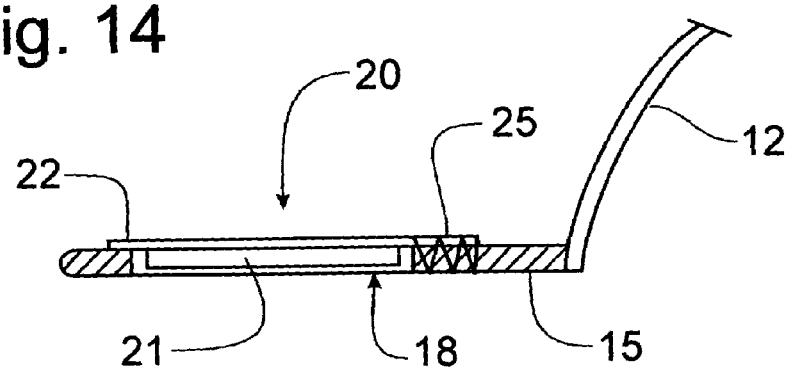
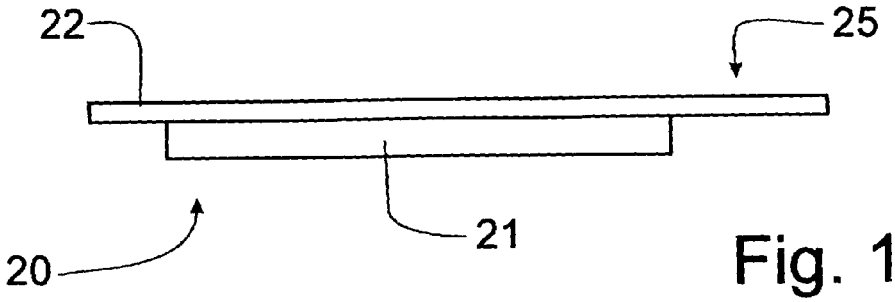
Fig. 15

Fig. 16
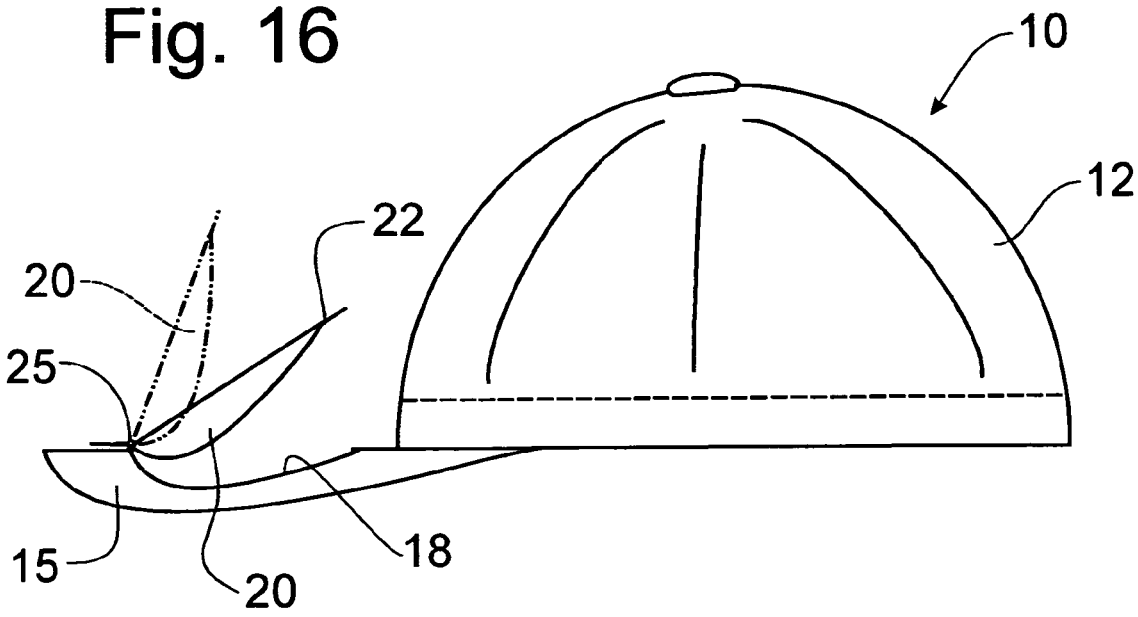
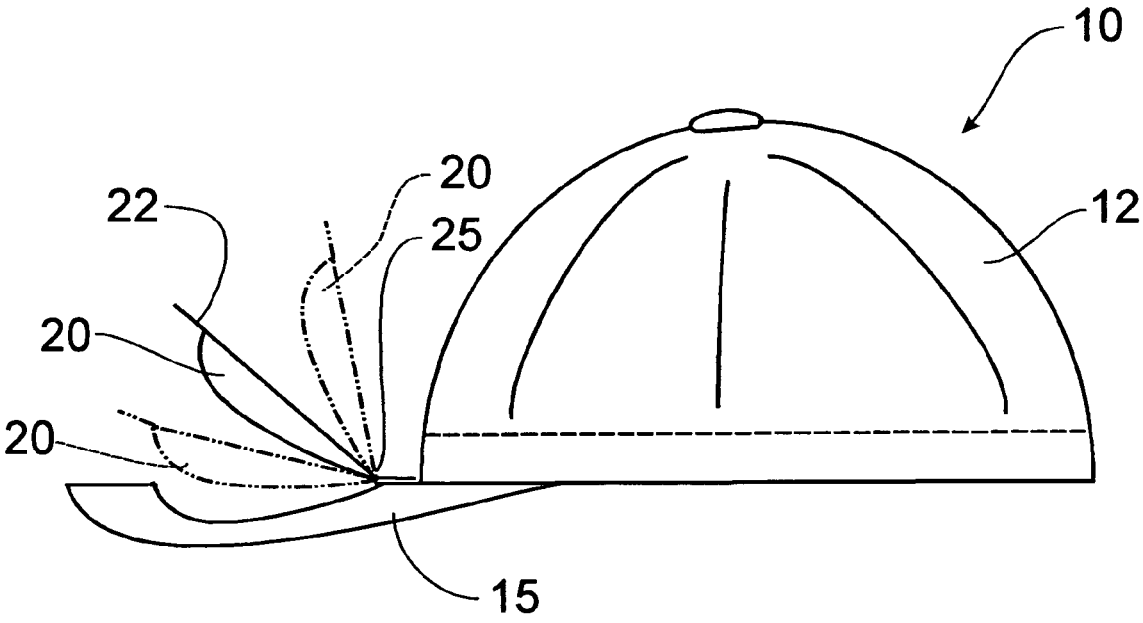
Fig. 17

CAP WITH HINGED VENT FLAPS IN VISOR

CROSS-REFERENCE TO RELATED APPLICATIONS

This application claims domestic priority on U.S. Provisional patent application Ser. No. 60/580,920, filed Jun. 21, 2004, the contents of which are incorporated herein by reference in its entirety.

BACKGROUND OF THE INVENTION

The present invention relates generally to visored caps, such as baseball caps and the like, and, more particularly, to a pivoted vent in the visor of the cap to permit air to flow through the visor to prevent an unintentional dislodging of the cap from the wearer's head under windy conditions.

Visored caps have a forwardly extending visor that presents an impediment to the flow of wind around the cap. Particularly since the visor projects only forwardly from caps such as athletic caps, the engagement of wind with the visor presents a lever against the retention of the cap on the wearer's head. Most caps will become dislodged from the wearer's head with only a minimal amount of air blowing up under the visor. Accordingly, wearing visored caps under windy conditions often results in the cap being removed from the wearer's head.

Vented athletic caps are known in the art in an attempt to resolve the problem of wind blowing up underneath the visor and effecting a dislodging of the cap. One such vented visor can be found in U.S. Pat. No. 2,874,387, issued to Constance Bannister on Feb. 24, 1959. In the Bannister patent, the visor is formed with a plurality of louvers that form vents across the transverse width of the visor to permit the flow of air through the visor and relieve the pressure on the visor due to its otherwise normal wind resistance. These louvers are preferably fixed, but an alternative embodiment provides for a pivoted louver structure in which the opening created from the position of the louver can be varied by pivoting the louver on a pivot pin that supports the louver relative to the rim of the visor. Furthermore, for pivotal movement of the louvers to be effective, the bill of the cap would need to be flat, as is depicted in the drawings, which is not an acceptable configuration for conventional sports or athletic caps.

In U.S. Pat. No. 6,598,237, issued to William Held on Jul. 29, 2003, an vent opening is formed in the body of the cap above the visor to permit the air to circulate into the body of the cap and cool the head of the wearer. A cover is selectively positionable to close the vent opening when air circulation is not desired.

Another louvered opening is provided in U.S. Pat. No. 5,487,191, issued to Robert Ridley on Jan. 30, 1996. The Ridley louvered opening is formed in a semi-circular shape with a plurality of triangularly-shaped louvers attached at an apex at the center of the semi-circular shaped opening where all the louvers are attached at a common point to the visor, and attached to the visor along the semi-circular periphery of the vent opening. As a result, the flexible triangular louvers are able to twist to permit a vent opening between overlapping louvers to become opened for the passage of air through the visor structure. Depending on the orientation of the cap with respect to the air flow of the wind engaging the cap, the flexible triangular louvers are capable of deflecting upwardly, or downwardly.

While these prior art visored caps provide a venting structure, none of the vent structures will be operable to prevent the dislodging of the cap under windy conditions as the visor cannot open a sufficiently large vent opening to permit the pressure exerted by the oncoming wind flow to be relieved. In each prior art cap, the louver remains in partial blockage of the potential vent opening that could be created if the louvers weren't present. Accordingly, it would be desirable to provide a vented athletic cap, e.g. a visored cap, in which the vent opening can be fully open for the passable of air through the visor and minimize the likelihood of the cap becoming dislodged from the wearer's head.

SUMMARY OF THE INVENTION

It is an object of this invention to provide a visored cap in which sufficiently large openings are formed to allow the passage of air through the visor to increase the likelihood that the cap will remain on the wearer's head under windy conditions.

It is a feature of this invention that the openings in the visor of the cap are covered by hinged flaps.

It is an advantage of this invention that the hinged flaps pivot upwardly under air pressure exerted from beneath the cap visor.

It is another feature of this invention that each hinged flap is formed by a first member having dimensions that correspond to the dimensions of the opening covered by the flap.

It is still another feature of this invention that each hinged flap is formed by a second member that is attached to the first member and has dimensions that are greater than the corresponding opening.

It is another advantage of this invention that the hinged flaps return to a seated position covering the opening when air pressure is reduced from underneath the cap's visor.

It is still another advantage of this invention that the movement of the hinged flap varies the size of the opening through the visor in accordance with the pressure gradient of the air beneath the cap's visor.

It is yet another feature of this invention that the flaps can be hinged to pivot rearwardly or to pivot forwardly.

It is still another feature of this invention that the first and second members forming the hinged flap can be separated to permit a different second member to be mounted on the first member.

It is yet another advantage of this invention that the second member can have an advertising logo imprinted thereon to be changed at the discretion of the wearer.

It is a further feature of this invention that the hinged flaps can be formed to cover a single large opening or a pair of smaller opening formed in the cap visor.

It is still a further feature of this invention that the flap hinges are arranged to permit a curved flap member to move about a pivot apparatus between a closed position in which the first member is seated within the corresponding opening in the visor, and a raised position in which the opening is opened for the passage of air therethrough.

It is another object of this invention to provide a cap visor in which openings are formed for the passage of air with hinged flaps mounted to the visor to cover the openings when no air is blowing upwardly through the openings.

It is still another object of this invention to provide a cap visor with hinged flaps covering openings therein, which is durable in construction, inexpensive of manufacture, carefree of maintenance, facile in assemblage, and simple and effective in use.

These and other objects, features and advantages are accomplished according to the instant invention by providing a visored cap, such as a baseball cap, in which the visor is formed with one or more openings through which air can pass from beneath the visor. The visor is provided with hinged flaps formed of two members to close the openings when no air is blowing the openings and pivotally open when air needs to be moved through the openings. The first member is sized to fit closely within the dimensions of the opening, while the second member is attached to the first member and is substantially larger than the first member to cover the opening. The second member is hinged to the visor for pivotal movement. The second member can be detachable from the first member to permit a substitution of a different imprinted logo on the second member. The hinge member is formed with side members to limit pivotal movement of the flap.

BRIEF DESCRIPTION OF THE DRAWINGS

The advantages of this invention will be apparent upon consideration of the following detailed disclosure of the invention, especially when taken in conjunction with the accompanying drawings wherein:

FIG. 1 is an upper, front perspective view of the visor portion of a visored cap incorporating the principles of the instant invention and having a front pivoted flap member moved into an opened position to expose an opening through the visor, the head portion of the cap being shown in phantom;

FIG. 2 is a lower, rear perspective view of the visor portion of the visored cap shown in FIG. 1;

FIG. 4 is an upper, front perspective view of the visor portion of a visored cap similar to that depicted in FIG. 1, but having the front pivoted flap member moved into a closed position;

FIG. 5 is a lower, rear perspective view of the visor portion of the visored cap shown in FIG. 4;

FIG. 7 is a schematic perspective view of a cap incorporating the principles of the instant invention, and having the vent flap formed as a single member pivoted at the rear;

FIG. 8 is a schematic perspective view of a cap depicting an alternative embodiment incorporating the principles of the instant invention, the vent flap being formed as two separate members;

FIG. 9 is a schematic front elevational view of the cap depicted in FIG. 7 with the vent flap being shown in the raised, deployed position;

FIG. 10 is a schematic front elevational view of the cap depicted in FIGS. 7 and 9 but with the vent flap being shown in the lowered, stored position;

FIG. 11 is a schematic front elevational view of the cap depicted in FIG. 8 with the vent flaps being shown in the raised, deployed position;

FIG. 12 is a schematic front elevational view of the cap depicted in FIGS. 8 and 11 but with the vent flaps being shown in the lowered, stored position;

FIG. 13 is a schematic side elevational view of the cap depicted in FIG. 7 with the visor being depicted in a flat configuration to better show the movement of the vent flap, which is depicted in phantom;

FIG. 14 is a cross-sectional view of the visor of the cap depicted in FIG. 13 but with the vent flap shown in the lowered, stored position;

FIG. 15 is an enlarged schematic detail view of the vent flap depicted in FIGS. 13 and 14;

FIG. 16 is a schematic side elevational view of a baseball cap similar to the embodiment of FIG. 7 and incorporating the principles of the instant invention, the vent flap being hinged along the forward edge;

FIG. 17 is a schematic side elevational view of a baseball cap similar to the embodiment of FIG. 16 with the vent flap being hinged along the rearward edge;

DETAILED DESCRIPTION OF THE PREFERRED EMBODIMENT

Figure 3:
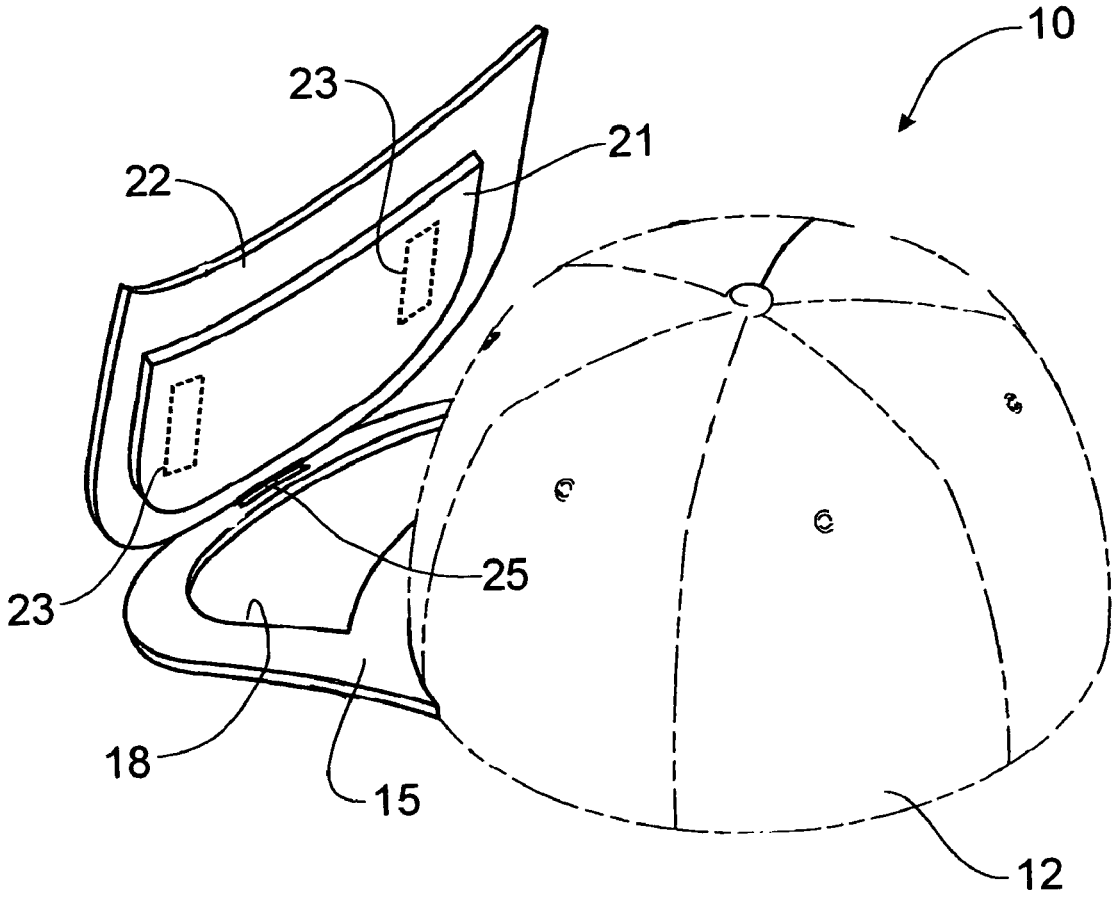
FIG. 3 is an upper, rear perspective view of the visor portion of the visored cap depicted in FIG. 1.

Referring now to the drawings, visored caps incorporating the principles of the instant invention can best be seen. The cap 10 includes a body portion 12 that encircles the wearer's head and covers the top portion of the wearer's head in a conventional manner. The cap also includes a visor 15 projecting forwardly from the body portion 12 in a conventional manner. The visor 15 is generally semi-circular in shape, though usually includes substantially linearly extending side edges. The cap 10 thus provides an article of headwear which may be positioned on top of the wearer's head. The visor 15 shades the eyes of the wearer and prevents the intrusion of direct sunlight. Accordingly, the cap 10 is typically utilized as an athletic cap, and specifically, as a baseball cap on which logos or other indicia can be placed on the body portion.

Wind currents can often blow up under the visor 15 and dislodge the cap 10 from the wearer's head. Such dislodging is often encountered when the wearer is running, as the wind currents generated simply by running is usually sufficient to dislodge an athletic cap. To permit the wind currents to pass through the visor and, thereby, relieve the pressure exerted on the visor by the wind currents, the visor 15 is formed with one or more hinged vent flaps 20 that will be seated within the structure of the visor 15 when not moved by wind currents, but are hingedly attached to the visor 15 to permit the flaps 20 to move upwardly and allow air to move through the opening 18 created in the visor 15 by the deflection of the flaps 20.

Figure 18:
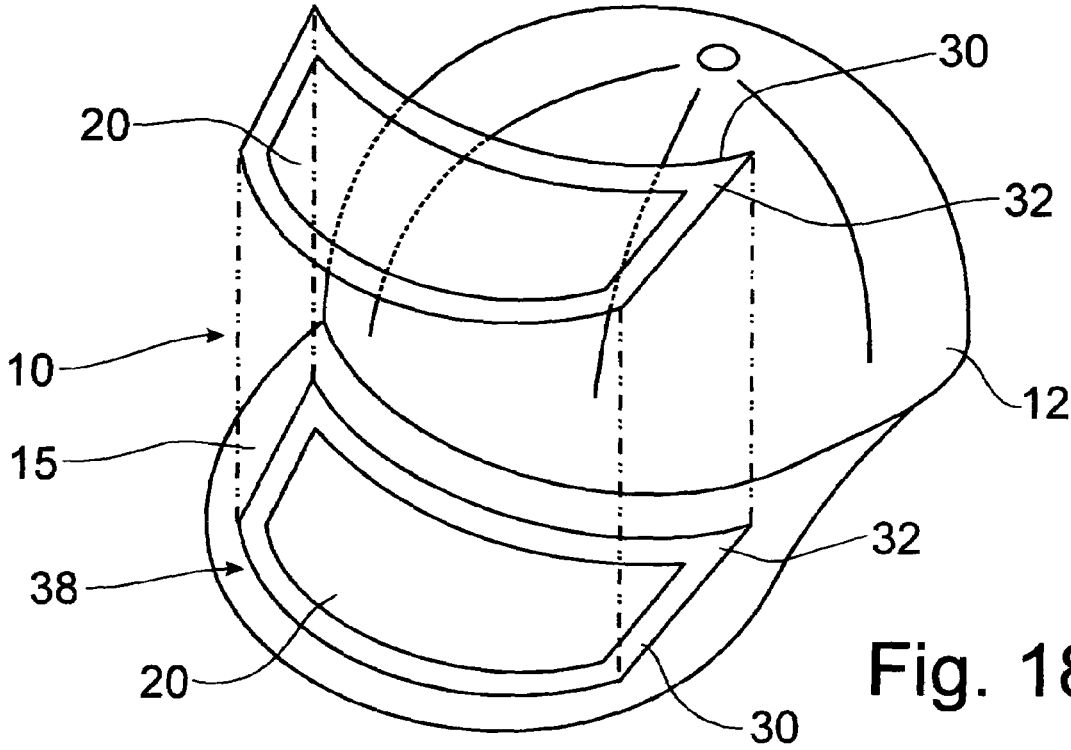
FIG. 18 is a schematic perspective view similar to that of FIG. 7, but depicting an alternative embodiment in which the vent flap is inserted into the visor of the cap as a previously manufactured sub-assembly.
Figure 19:
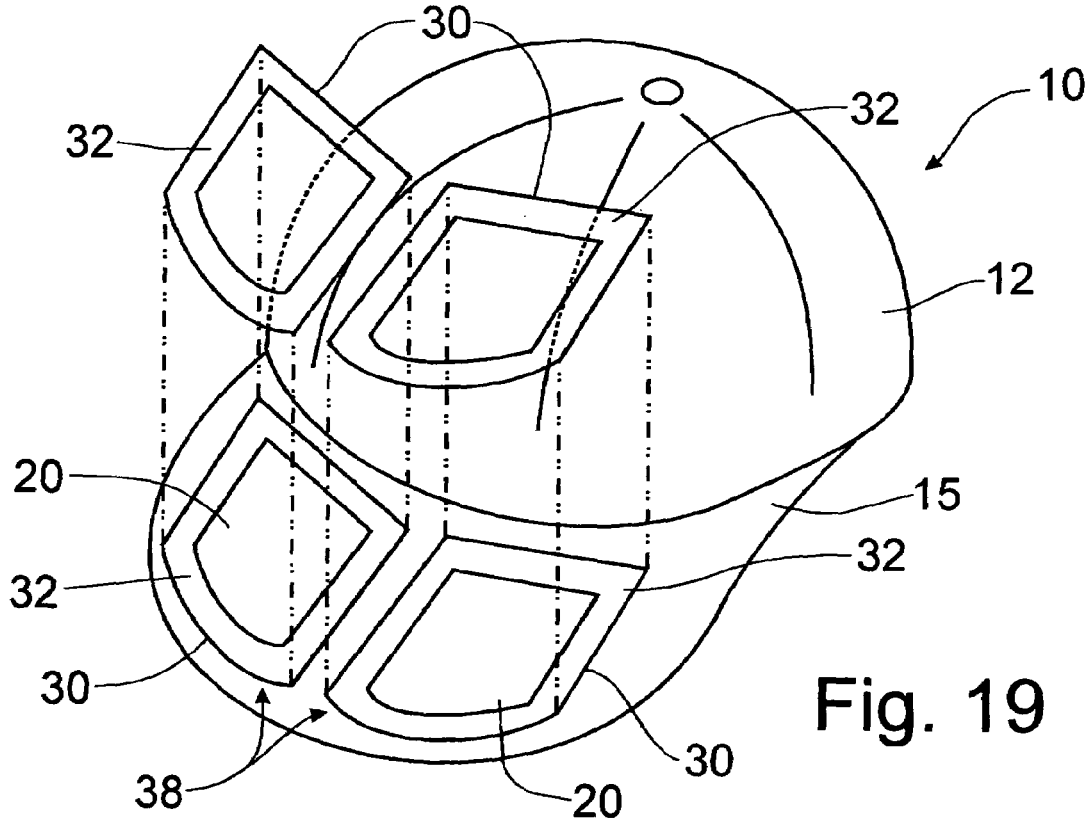
FIG. 19 is a schematic perspective view similar to that of FIG. 8, but depicting an alternative embodiment in which the vent flap is inserted into the visor of the cap as a previously manufactured sub-assembly.

As is best seen in FIGS. 1–6, the flap 20 can be formed as a single member that can be hinged at either the front, as depicted in FIGS. 1–6, or the rear, as depicted in FIG. 17. An alternative embodiment is depicted in FIGS. 8, 11 and 12 in which the vent flaps 20 are formed in a smaller configuration and paired on the visor 15. As with the single member configuration, the smaller paired vent flaps 20 can be hinged at the front edge or at the rearward edge. As depicted in FIGS. 18 and 19, the vent flaps 20 can be pre-manufactured as a sub-assembly 30 and attached to the visor 15, as will be described in greater detail below.

The flaps 20 are attached to the visor 15 by a hinge member 25 that interconnects the visor 15 and each respective flap 20. The hinge member 25 can be positioned forwardly of flap 20, as shown in FIGS. 1–6, or rearwardly of the flap 20, as is depicted in FIGS. 7, 8, 13, 14 and 17. Preferably, the hinge members 25 are positioned forwardly of the flap 20 so as to deflect the air passing through the visor 15 rearwardly and around the body portion 12. Alternatively, the rearwardly positioned hinge members 25 will deflect air currents upwardly and forwardly through the visor 15.

With the flaps 20 deflected upwardly, the openings 18 created in the visor 15 are not occluded and air is free to flow through the openings 18 in an unrestricted manner. The hinge member 25 can simply be flexible cloth members that are stitched (as is schematically depicted in FIGS. 7, 8 and 14) or glued to both the visor 15 and the flap 20, or can be more sophisticated, and therefore, more expensive to manufacture. The hinge member 25 can be positioned at the center of the flap 20, particularly when located along the forward edge of the flap 20, or at a pair of transversely spaced locations to accommodate the curvature of the visor 15, which is particularly useful when the hinge 25 is located along the rearward edge of the flap 20.

The hinge member 25 can include a biasing member (not shown) that will gently urge the flap or flaps 20 into a seated position in the visor 15. If a biasing member is utilized, the bias exerted must be light so as not to present any substantial restriction on the upward movement of the flap or flaps 20 for the flow of air through the opening 18 created in the visor 15. The hinge member 25, as is best seen in FIG. 6A, can be formed with a limit restrictor 27 that limits the amount of pivotal movement allotted to the flap 20. By constructing the hinge 25 with flexible side members 28, the top and bottom portions of the hinge member 25 can only separate a limited distance, thus defining the limit restrictor 27. Other forms of limit restrictors 27 are within the skill in the art as substitute for the side members 28, including side connectors (not shown) extending between the flap 20 and the visor 15.

Preferably, the flap 20 will be formed in a two-piece configuration with a first insert member 21 that is slightly smaller than the corresponding opening 18 so as to prevent the flap 20 from binding against the visor 15 when moving into and out of the seated position. To prevent the undersized insert member 21 from falling through the opening 18 in the visor 15, the flap 20 can be provided with a circumferential seal member 22, which can also be formed of light cloth material. As depicted in FIGS. 1–6, 14 and 15, the seal member 22 can preferably cover the entire insert member 21 to overlap the opening 18 circumferentially on all sides. In one configuration, one of the sides of the seal member 22 can be attached to the visor 15 to become the hinge 25. In another configuration, the hinge 25 is attached to the edge of the seal member 22 to provide the connection between the visor 15 and the flap 20.

Figure 6:
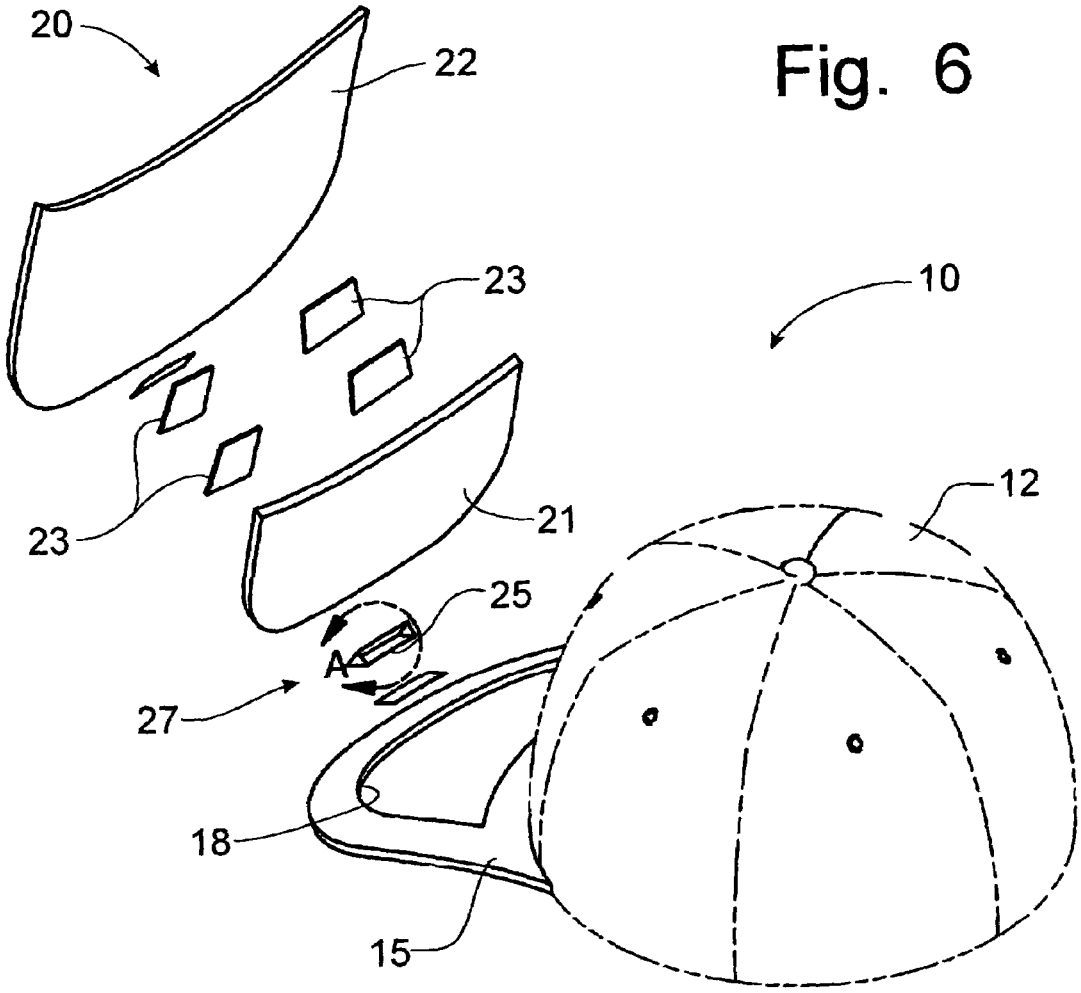
FIG. 6 is an upper, rear perspective exploded view of the visor similar to the view shown in FIG. 3.
Figure 6A:
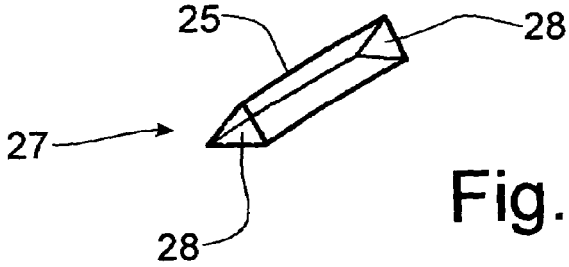
FIG. 6A is an enlarged perspective view of the hinge and limit restrictor.

As is best seen in FIG. 6, the insert member 21 and the seal member 22 are preferably formed as separate pieces, but can be detachably connected, such as through hook and loop fastener material 23. Such detachable formation of the insert member and the seal member 22 permit the seal member 22 to be replaceable independently of the insert member 21. For example, the seal member 22, which has an exterior surface that oscillates between being flush with the visor 15 and being generally perpendicular to the visor 15, particularly when the flap 20 is pivoted along the forward edge, can be used to display advertisement, such as logos. Replaceable seal members 22 enable the advertised logo to be changed as desired.

The flaps can be formed in a single flap 20 configuration with a corresponding single opening 18 through the visor 15, as is shown in FIGS. 1–7, or be formed with multiple flaps 20 having a like number of corresponding openings 18, as is depicted in FIG. 8. In either configuration, the flaps 20 can be formed as a self-contained sub-assembly 30, as shown in FIGS. 18 and 19, that can be inserted and then attached, e.g. glued or stitched into a pre-formed opening 38 in the visor 15. The sub-assembly 30 would be formed with an outer frame 32, which could be formed from plastic or other suitable material and seated into the pre-formed opening 38. The hinge member 25 would be attached to the outer frame 32 and connected to the flap 20 to permit the upward movement of the flap 20 to expose the opening 18 formed in the frame 32. Such an assembly 30 would facilitate mass production manufacture of the vented cap 10. Furthermore, the flap 20 and hinge member 25 in the assembly 30 could be manufactured from more durable material, such as plastic.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. In a head covering including a body portion and a visor projecting forwardly from the visor to project forwardly over a wearer's face, the improvement comprising:

a flap member pivotally supported on said visor to cover an opening formed therein, said flap member being pivotally movable between a stored position in which said flap member is seated against said visor and a deployed position in which said flap member is pivoted upwardly about a pivot axis to expose said opening and allow the passage of air therethrough, said flap member being formed from a first insert member that is sized to be smaller than said opening and a second seal member that is sized to be larger than said opening, said seal member preventing said flap member from passing through said opening when moving from said deployed position to said stored position.

2. The head covering of claim 1 wherein said insert member is detachable from said seal member.

3. The head covering of claim 2 wherein said insert member is connected to said seal member by hook and loop fastener material.

4. The head covering of claim 1 further comprising a hinge attached to said seal member and defining said pivot axis.

5. The head covering of claim 4 wherein said hinge is located along a forward edge of said seal member such that said flap member pivots forwardly to expose said opening.

6. The head covering of claim 4 wherein said hinge is located along a rearward edge of said seal member such that said flap member pivots rearwardly to expose said opening.

7. The head covering of claim 6 wherein said hinge is formed from first and second hinge members spaced transversely along said rearward edge of said seal member.

8. The head covering of claim 1 further comprising a second flap member, said visor having formed therein a second opening corresponding to said second flap member.

9. The head covering of claim 8 wherein said first and second flap members are independently movable with respect to said visor.

10. The head covering of claim 1 wherein said flap member is pivotally connected to a frame member that is mounted in said opening through said visor.

11. The head covering of claim 10 further comprising a hinge member defining said pivot axis, said hinge member being mounted on said frame and connecting said seal member for pivotally supporting said flap member.

12. A cap for covering a wearer's head comprising:

a body portion engagable with the wearer's head;

a visor projecting forwardly from said body portion to project forwardly over said wearer's face, said visor being formed with an opening extending generally vertically therethrough; and a flap member pivotally supported on said visor for movement between a lowered stored position adjacent said visor and a raised deployed position oriented generally perpendicularly to said visor, said flap member being connected to a hinge member to define a pivot axis about which said flap member is pivotally movable, said hinge having a limit restrictor associated therewith to limit the pivotal movement of said flap member.

13. The cap of claim 12 wherein said hinge member is located along a forward edge of said flap member such that said flap member pivots forwardly to expose said opening.

14. The cap of claim 12 wherein said hinge member is located along a rearward edge of said flap member such that said flap member pivots rearwardly to expose said opening.

15. The cap of claim 12 further comprising a second flap member, said visor having formed therein a second opening corresponding to said second flap member, said first and second flap members being independently movable with respect to said visor.

16. The cap of claim 12 wherein said flap member is formed from an insert member that is sized to be smaller than said opening and a seal member connected to said insert member, said seal member being sized to be larger than said opening to prevent said flap member from passing through said opening when moving from said deployed position to said stored position.

17. The cap of claim 16 wherein said flap member is pivotally connected to a frame member that is mounted in said opening through said visor, said hinge member being mounted on said frame and connecting said seal member for pivotally supporting said flap member.

18. A visored cap including a body portion and a visor extending outwardly from said body portion, comprising:

a generally vertical opening formed in said visor for the passage of air upwardly through said visor;

a flap member mounted on said visor for engagement with said visor at said opening, said flap member being movable between a lowered stored position located against said visor in which said flap member closes said opening, and a raised deployed position oriented generally perpendicularly to said visor to expose said opening to permit the passage of air through said opening, said flap member being formed from an insert member sized to be smaller than said opening and a seal member sized to be larger than said opening; and said hinge member being located along a forward edge of said seal member such that said flap member pivots forwardly in moving from said stored position to said deployed position.

19. The visored cap of claim 18 further comprising a frame member mounted in said opening through said visor, said hinge member being mounted on said frame member and connected to said seal member for pivotally supporting said flap member for movement between said stored and deployed positions.

* * * * *